US006409033B1

(12) United States Patent
Wilhite et al.

(10) Patent No.: US 6,409,033 B1
(45) Date of Patent: Jun. 25, 2002

(54) DEVICE FOR MAINTAINING EFFERVESCENCE OF A BEVERAGE WITHIN A CONTAINER

(75) Inventors: Gerald Wilhite, Southlake; Donald Saller, Garland, both of TX (US)

(73) Assignee: Jokari/US, Carrollton, TX (US)

( * ) Notice: Subject to any disclaimer, the term of this patent is extended or adjusted under 35 U.S.C. 154(b) by 0 days.

(21) Appl. No.: 09/592,717

(22) Filed: Jun. 13, 2000

Related U.S. Application Data

(60) Provisional application No. 60/141,044, filed on Jun. 24, 1999, and provisional application No. 60/176,194, filed on Jan. 14, 2000.

(51) Int. Cl.[7] ..... B65D 51/24

(52) U.S. Cl. ..... 215/228; 215/237

(58) Field of Search ..... 215/228, 260, 215/262, 269, 309, 311, 235, 237; 220/212, 231, 833–835, 837, 847, 259

(56) References Cited

U.S. PATENT DOCUMENTS

| | | | | | |
|---|---|---|---|---|---|
| 102,669 | A | | 5/1870 | Ely | |
| 3,557,986 | A | * | 1/1971 | Poole, Jr. | 215/228 |
| 3,602,387 | A | * | 8/1971 | Patnaude | 215/228 |
| 4,033,091 | A | * | 7/1977 | Saponara | 215/228 |
| 4,640,426 | A | * | 2/1987 | Wasley | 215/228 |
| 4,763,802 | A | | 8/1988 | Johnston | |
| 4,787,526 | A | | 11/1988 | Pehr | |
| 5,320,232 | A | | 6/1994 | Maguire et al. | |
| 5,558,243 | A | * | 9/1996 | Chu | 215/228 |
| 5,653,352 | A | * | 8/1997 | Kim | 215/228 |
| 5,692,632 | A | * | 12/1997 | Hsieh et al. | 215/228 |
| 5,817,066 | A | | 10/1998 | Goforth | |
| 5,823,372 | A | | 10/1998 | Levine | |
| 5,836,364 | A | | 11/1998 | Burton | |
| 5,957,317 | A | * | 9/1999 | Lee | 215/228 |
| 5,992,666 | A | * | 11/1999 | Wu | 215/228 |

FOREIGN PATENT DOCUMENTS

| | | |
|---|---|---|
| DE | 3400283 | 1/1984 |
| DE | 3630047 | * 11/1987 |
| FR | 2343665 | 10/1977 |

* cited by examiner

*Primary Examiner*—Nathan J. Newhouse
(74) *Attorney, Agent, or Firm*—Edward D. Gilhooly

(57) ABSTRACT

A device for maintaining effervescence of a beverage within a container having a body for attachment to the container and a snap cap pivotally mounted on the body. A squeezable bulb provide a source of air pressure to the container. A pair of valve assemblies control air flow to permit pressurization and maintainence of pressure within the container.

12 Claims, 7 Drawing Sheets

6
4
10b
10a
64
60'
18'
62
66'
52'
50'
20'
54'
12
36
22'
8'
8
26
28'
34
22
46
12'
32
50
20
34a
18
42
44
40
14
15
14a
16a
16

2
4
8
26
28
42
34
40
14
34a
10a
10

DEVICE FOR MAINTAINING EFFERVESCENCE OF A BEVERAGE WITHIN A CONTAINER

This application claims the priority date of filing of the provisional applications, Ser. No. 60/141,044, filed Jun. 24, 1999 and Ser. No. 60/176,194, filed Jan. 14, 2000.

BACKGROUND OF THE INVENTION

1. Field of the Invention

This invention relates in general to beverage containers and, more particularly, to a device for maintaining pressure within a container having a carbonated beverage.

2. Summary of the Prior Art

It is a common problem to experience a loss of effervescence or fizz of a beverage from a container, such as a plastic bottle, during storage after being opened. Several devices have been introduced in the prior art to provide a better seal of an opened bottle to prevent loss of fizz. Other techniques have also attempted to pressurize the interior of the bottle in combination with an enhanced seal to maintain effervescence of the beverage. Such designs rely on inconvenient means such as hand pumps and the like. Although prior designs have met with some degree of success, none have combined the optimum effectiveness in maintaining fizz, with ease of use, economy of manufacture, and an aesthetically pleasing design as is desirable.

SUMMARY OF THE INVENTION

It is, therefore, an objective of the invention to provide a device for maintaining the fizz or effervescence of a beverage within an opened container, such as a plastic bottle. The invention of the application is attachable to the open top of a container and includes a squeezeable bulb capable of pressurizing the interior of the container to maintain fizz. The bulb may be constructed with an aesthetically pleasing shape, such as a cartoon character. Valve means of the invention cooperates with the bulb and container to allow pressurized air into the container, but prevents release of pressure when the bottle is pressurized. The device herein disclosed has a snap action cap to maintain a seal or easily open the container.

DESCRIPTION OF THE PREFERRED EMBODIMENT

Figures 1, 2:
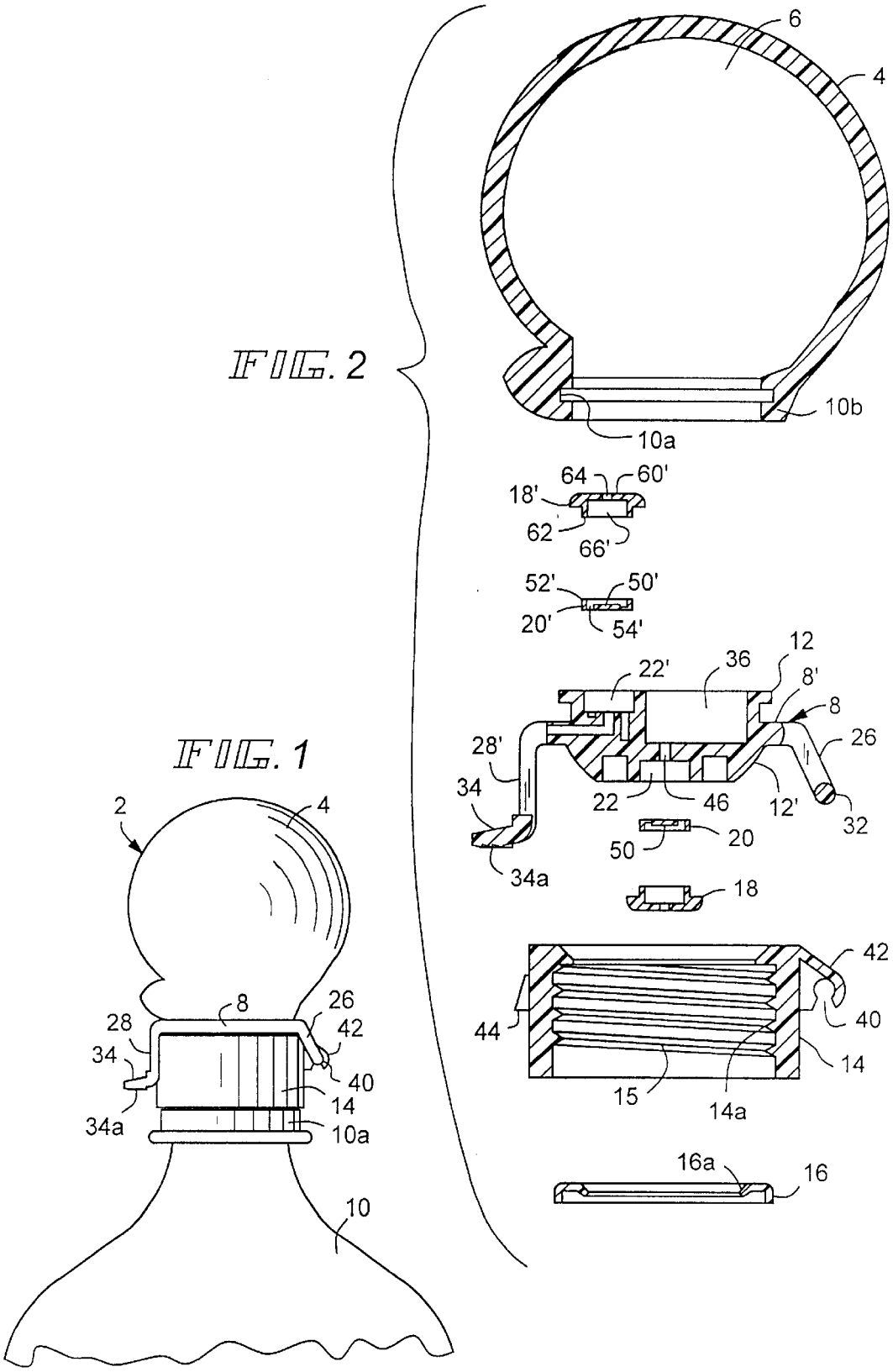
FIG. 1 is a side elevational view of the device for maintaining effervescence of a beverage of the invention attached to a plastic container.
FIG. 2 is a side elevational view, with parts in section and parts shown exploded, of the device of FIG. 1.
Figure 3:
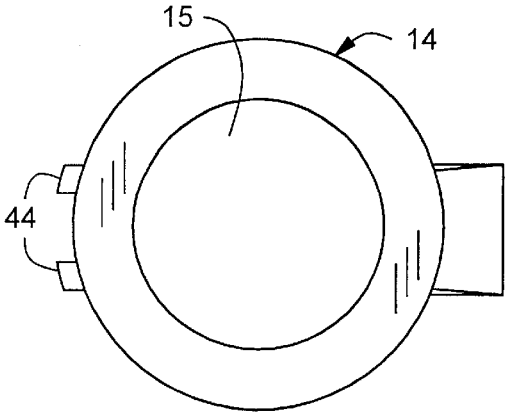
FIG. 3 is a top plan view of the screw cap of the device of FIG. 1.
Figure 6:
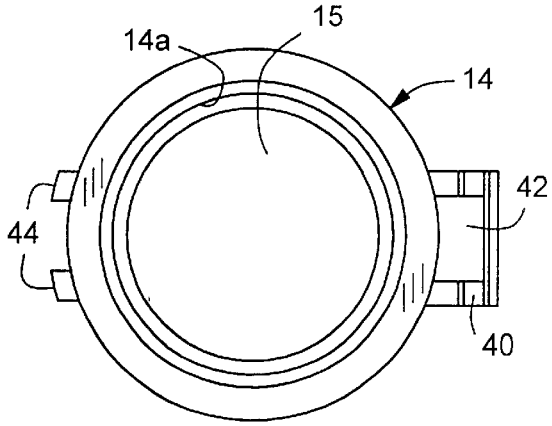
FIG. 6 is a bottom plan view of the screw of the cap of FIG. 3.
Figure 4:
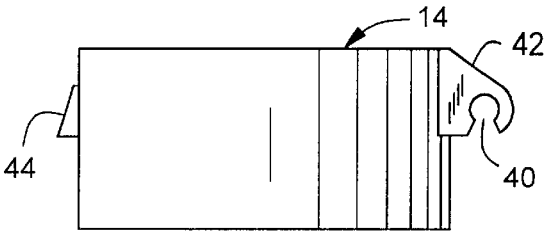
FIG. 4 is a side elevational view of the screw cap of FIG. 3.
Figure 7:
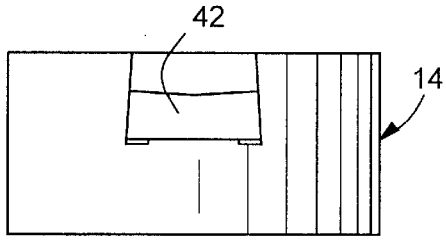
FIG. 7 is a front elevational view of the screw cap of FIG. 3.
Figure 5:
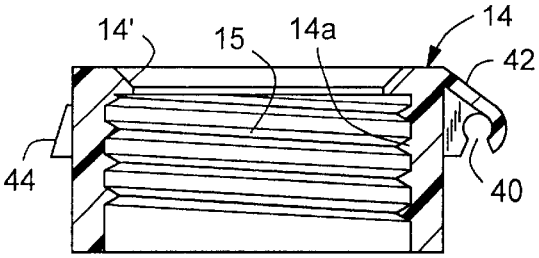
FIG. 5 is a side elevational view, with parts in section, of the side view of the screw cap of FIG. 4.
Figure 8:
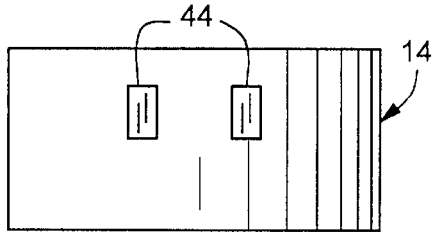
FIG. 8 is a back elevational view of the screw cap of FIG. 3.
Figure 9:
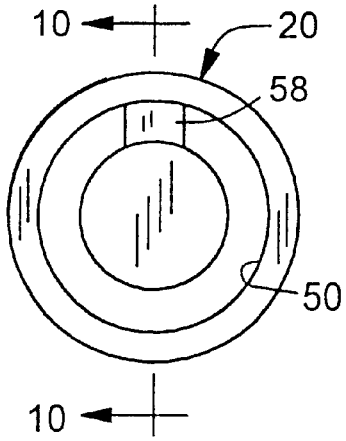
FIG. 9 is a top plan view of one of the two valves of the device of FIG. 1.

Referring now to FIGS. 1 and 2, there is illustrated the device of the invention for maintaining effervescence of a beverage within a container, generally designated by reference numeral 2. The device 2 includes an upper bulb 4 fabricated from a compressible rubber or plastic material surrounding chamber 6. The upper bulb 4 can have an aesthetically pleasing shape, such in the form of an animal, cartoon character and the like. The bulb 4 is squeezed to be compressed in shape to displace air under pressure through the effect of reducing volume of the chamber and introduce air pressure into a snap cap 8 for pressurizing the container 10 of a standard design in a manner as will be apparent. The snap cap 8 may be a molded plastic member and includes a circumferentially extending lip 12 for attachment to bulb 4. A continuous groove 4*a* is formed in the neck 4*b* defining the outlet of the bulb 4 to receive lip 12 in a sealed relationship. The snap cap 8 is pivotally connected to a plastic screw cap body 14 to open and close the bottle 10 as further will be described. The screw cap 14 has internal threads 14*a* (FIGS. 2 and 5) to be secured to the threaded upper neck portion 10*a* of bottle 10. The screw cap 14 is further provided with central passage 15 as seen in FIGS. 2, 3, 5, and 6 which is selectively in fluid communication with bulb 4 and the interior of container 10. A compressible ring 16 having a continuous lip 16*a* (FIG. 2) is inserted into the lower interior of screw cap 14 to create a circumferential seal with the neck portion 10*a* of bottle 10. The snap cap 8 receives a lower valve cap 18 and valve 20 within cavity 22 in the bottom of snap cap 8 and an upper valve cap 18' and valve 20' within cavity 22' in the top of snap cap 8 to control air flow.

Referring to FIGS. 13 to 18 details of snap cap 8 are shown. The snap cap 8 possesses a body 8' having downwardly extending spaced rear legs 26 and downwardly extending spaced front legs 28. A horizontal member 32 connects legs 26 at their lower end and a horizontal member 34 having upper surface 34' connects legs 28 at their lower end and has an upper surface 34'. The horizontal member 34 serves as a handle to open and close bottle 10 with the aid of grooved bottom surface 34*a*. As seen in FIGS. 2, 13, 17 and 18, a central air passage 46 is provided through the snap cap body 8'. An air passage 48 is also provided on the snap cap body 8' from the exterior (FIGS. 14 and 15) to provide air through port 48*a* into cavity 22' and bulb cavity 6 dependent on pressure conditions.

Referring to FIGS. 2–8, the horizontal member 32 is arranged to be snapped in downwardly facing groove 40 formed in the lower portion of a pair of rear projections 42 provided on screw cap 14 in a manner to create the pivot axis of snap cap 8. As further seen in FIGS. 1–6, a pair of spaced projections 44 project from the front of screw cap 14 to engage the upper surface 34 horizontal member 34 to lock the snap cap 8 to the screw cap 14 as best illustrated in FIGS. 2, 3, 4, 6 and 8. The legs 28 are sufficiently flexible to allow the horizontal member 34 of snap cap 8 to be released from engagement with spaced projections 44 for locking and release. The bottom portion 12' of cap 8 creates circumferentially extending curved surface having a decreasing diameter to engage lip 14' of screw cap 14.

Figure 10:
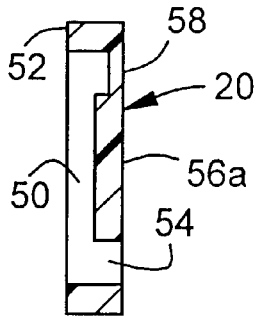
FIG. 10 is a side elevational view, with parts in section, taken along lines 10—10 of FIG. 9.
Figure 12:
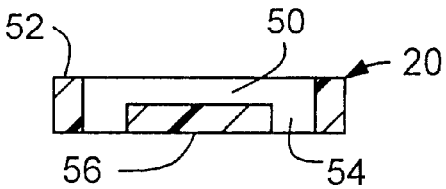
FIG. 12 is a sectional view taken along lines 12—12 of FIG. 11.
Figure 11:
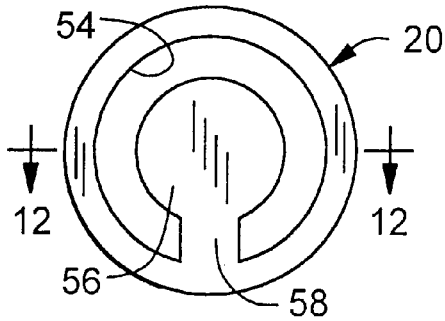
FIG. 11 is a bottom plan view of one of the two valves of FIG. 9.
Figure 13:
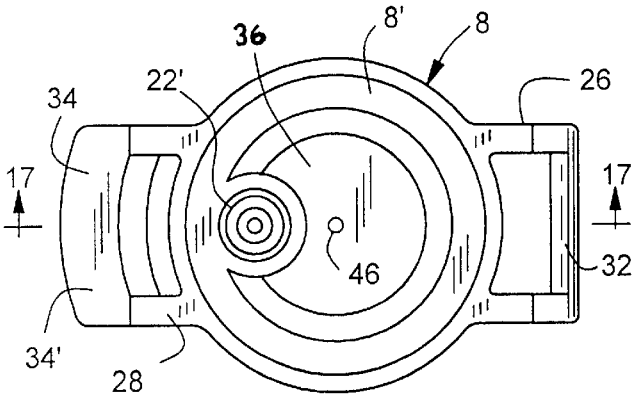
FIG. 13 is a top plan view of the snap cap of the device of FIG. 1.
Figure 14:
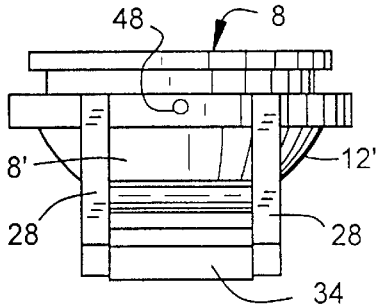
FIG. 14 is a front elevational view of the snap cap of FIG. 13.
Figure 15:
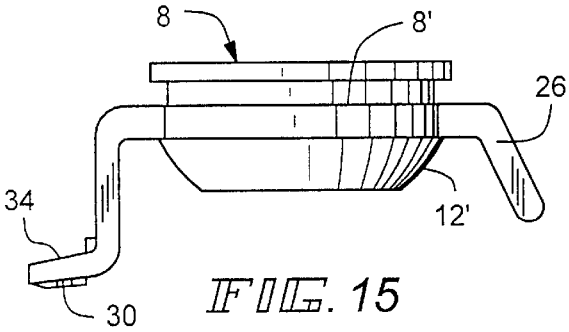
FIG. 15 is a side elevational view of the snap cap of FIG. 14.
Figure 16:
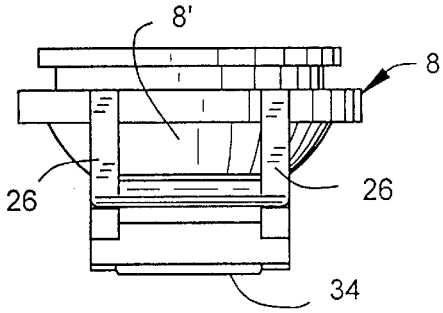
FIG. 16 is a back elevational view of the snap cap of FIG. 14.
Figure 17:
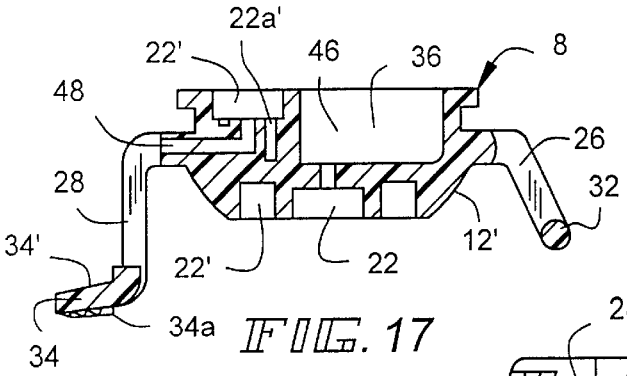
FIG. 17 is a side elevational view, with parts in section, of the snap cap of FIG. 14.
Figure 18:
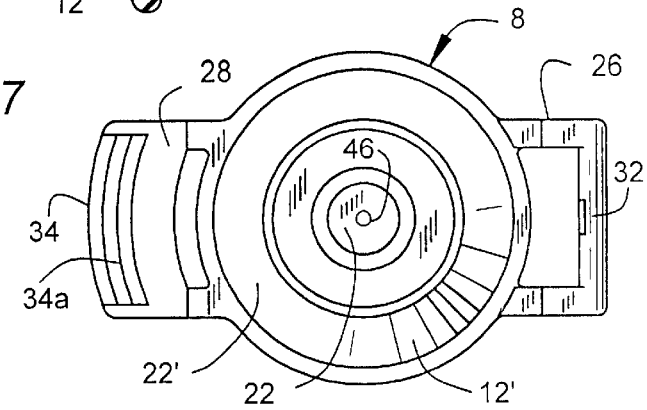
FIG. 18 is a bottom plan view of the snap cap of FIG. 14.

Referring to FIGS. 2 and 9 to 12, details of valve 20 are shown. Valve 20' is identical to the structure shown in FIGS. 9 to 12 with reference to valve 20, but is in reversed orientation in the top cavity 22'. Valve 20 is formed as a plastic disc having a circular cut out central area 50 defined by circular periphery 52. An open passage 54 is in fluid communication with the upper cut area 50 and is exposed at bottom of valve 20 when in position within cavity 22. The open passage 54 extends in a circumferentially extending path for an extent of greater than 270°, but less than 360° and is in fluid communication with upper cutout area 50. Valve 20' has an identical central cutout area 50', periphery 52', and open passage 54' (FIG. 2). Valves 20, 20' respectively have central solid portions 56, 56' connecting portions 58, 58' and outer periphery 52, 52'. As seen in FIGS. 10 and 12 the central portion 56 is thinner than periphery 52 and has a face 57 in alignment with the face 52*a* of peripheral section 52. The connecting portion 58, 58' are sectionally thinner than central portion 56 to create a pressure sensitive flexure area. The connecting portions 58, 58' allow flexure of solid portions 56, 56' with respect to periphery 52, 52' to provide valve seating as will be described.

Figure 19:
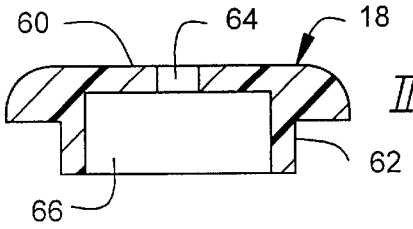
FIG. 19 is a front elevational view, with parts in section, of one of the valve caps of the device of FIG. 1.
Figure 20:
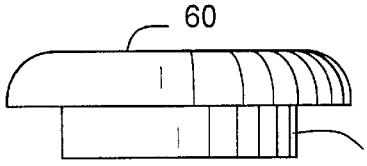
FIG. 20 is a side elevation view of one of the valve caps of the device of FIG. 1.
Figure 21:
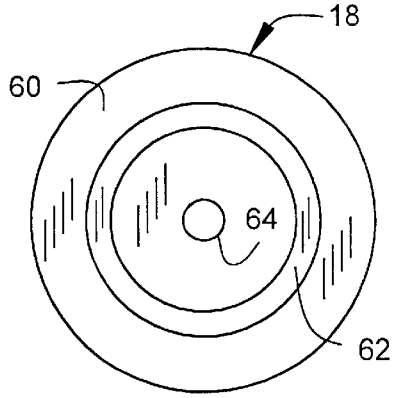
FIG. 21 is a top view of one of the valve caps of the device of FIG. 1.
Figure 22:
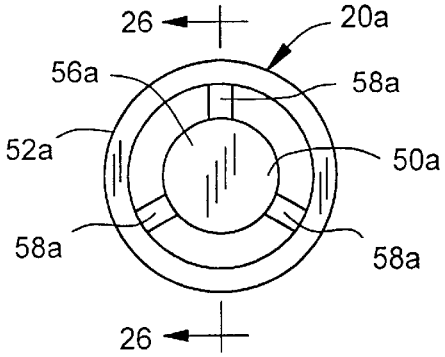
FIG. 22 is a top plan view of a second embodiment of one of two valves for use in the device for maintaining effervescence of a beverage within a bottle of the invention.

Referring to FIGS. 2 and 19–21, details of the valve cap 18 of valve 20 are shown. Valve cap 18 is identical to valve cap 18' to be inserted in upper cavity 22' of valve 20, but is reversed in orientation when inserted. As seen in FIGS. 19–21, valve cap 18 has a one-piece body with an enlarged circular portion 60 having a diameter greater than cavity 22 of valve 20 and a hollow tubular projection 62 adapted for insertion in cavity 22. A central port 64 is formed in the bottom of upper portion 60 at diametrical opposite directions above circular projection 62 and extends from the interior face 60*a* of circular portion 60 to the outer surface 60*b* of enlarged portion 60. The circular projection 62 when inserted in cavity 22 contracts the interior surface of portion 60 and forms a chamber 66 which is in communication with cavity 66. The cavity 66 is in selective communication with passages 64 dependent on pressure conditions. Upper valve cap 18' has an identical enlarged portion 60', tubular projection 62', rectangular passages 64' and chamber 66' as lower valve cap 18.

The respective heights of valves 20, 20' are slightly less than the depth of chambers 66, 66' formed by the valve caps 18, 18'. The valves 20, 20' are opened whenever air pressure may flow to the bottle 10 when passage 36 is uncovered and to bulb 4 when passage 38 is uncovered. As bulb 4 is squeezed with snap cap 4 locked, the central portion 56' of valve 20' is closed by being displaced through flexure of connecting portion 58' downward into chamber 66' by pressure being introduced into ports 64' of valve cap 18' to prevent atmospheric air from passage 48 from entering because lower portion 56' blocks port 48*a*. At the same time the central portion 56 of lower valve 20 is displaced away from passage 48 by the pressure created in chamber 36 by squeezing bulb 6. As a result of opening passage 38 by displacement of central portion 56 of valve 20, pressurized air from chamber 36 flows through valve 20 via passage 54 and valve cap passages 64 into the central passage 15 of screw cap 14 to pressurize the bottle. After the bulb is squeezed and released, the elasticity of bulb 6 returns the bulb to its normal shape thereby reducing the pressure in chamber 36. The lower valve 20 is pressed through flexure of central portion 56 into contact with the lower portion of snap cap 8 whereby the surface of central portion 56 of valve 20 closes the valve by covering passage 48. As the bulb expands, atmospheric pressure becomes greater than the pressure in chamber 36 to displace the central portion 56' of valve 20' and open port 48*a* of passage 48 to allow atmospheric air through valve 20' and ports 64'. The foregoing squeezing and release of bulb 4 may be repeated as desired for needed pressurization of bottle 10.

Figure 26:
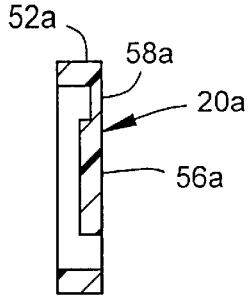
FIG. 26 is a side elevational view, with parts in section, taken along lines 26—26 of FIG. 22.
Figure 23:
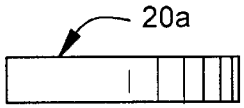
FIG. 23 is a side elevational view of the valve of FIG. 27.
Figure 24:
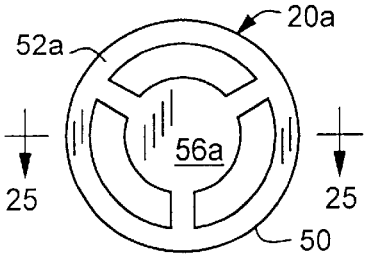
FIG. 24 is a bottom plan view of the valve of FIG. 22.
Figure 25:
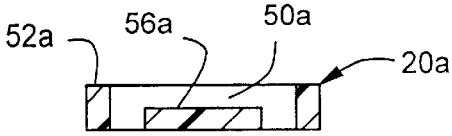
FIG. 25 is a front elevational view, with parts in section, taken along lines 25—25 of FIG. 24.
Figure 27:
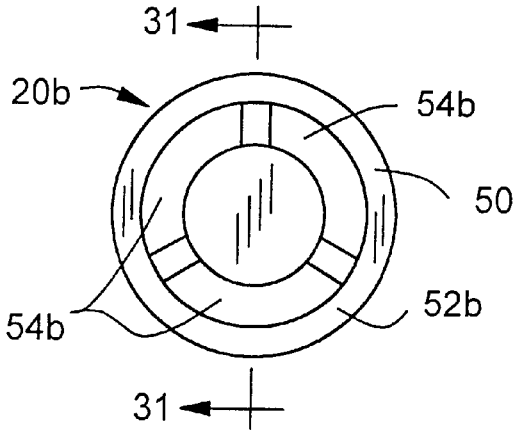
FIG. 27 is a top plan view of a third embodiment of one of two valves for use in the device for maintaining effervescence of a beverage within a bottle of the invention.

Referring to FIGS. 22 to 26 there is illustrated a second embodiment of the lower valve disc, designated as valve 20*a*, for use with the valve cap 18 of FIG. 2. The upper valve (not shown) is intended for use in device 2 with valve cap 60' and is identical to valve 20*a*, but has a reversed orientation in use in the manner as the previously described valves 20, 20'. Valve 20*a* is intended to improve valve seating as compared to valves 20 and 20' previously described. Valve 20*a* is in the form of a plastic disc having a cutout central area 50*a* and a circular periphery 52*a*. A plurality of open passages 54*a*, three in number, are in fluid communication with the upper cutout area 50*a*. Valve 20*a* has a central solid portion 56*a* and three connecting portions 58*a* which interconnect central solid portion 56*a* with circular periphery 52*a*. The connecting portions 58*a* allow flexure of central portion 56*a* with respect to periphery 52*a* to provide valve seating as will be described. As seen in FIGS. 25 and 26, the central portion 56*a* is thinner than periphery 52*a* and has a face 57*a* in alignment with face 52*a*' of peripheral section 52. The connecting portions 58*a* are sectionally thinner than central portion 56*a* to create three pressure sensitive flexure areas. The use of three flexure areas provides controlled movement of central portion 56*a* for enhanced seating to close the valve and prevent jamming.

Figure 31:
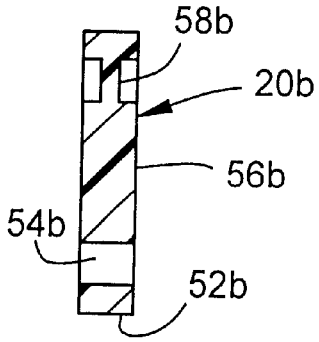
FIG. 31 is a side elevational view, with parts in section, taken along lines 31—31 of FIG. 27.
Figure 28:
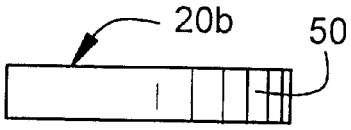
FIG. 28 is a side elevational view of the valve of FIG. 27.
Figure 30:
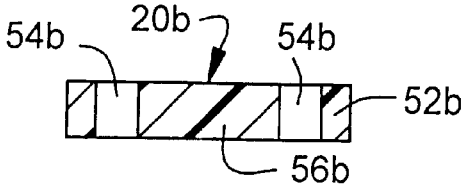
FIG. 30 is a front elevational view, with parts in section, taken along lines 30—30 of FIG. 29.
Figure 29:
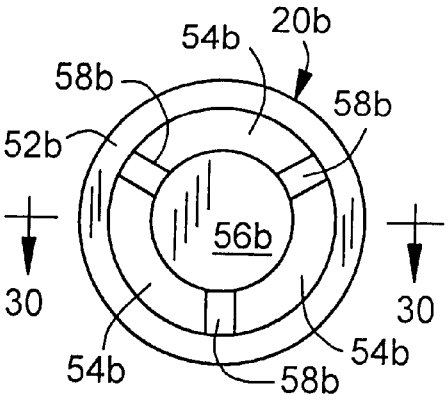
FIG. 29 is a bottom plan view of valve of FIG. 27.
Figure 32:
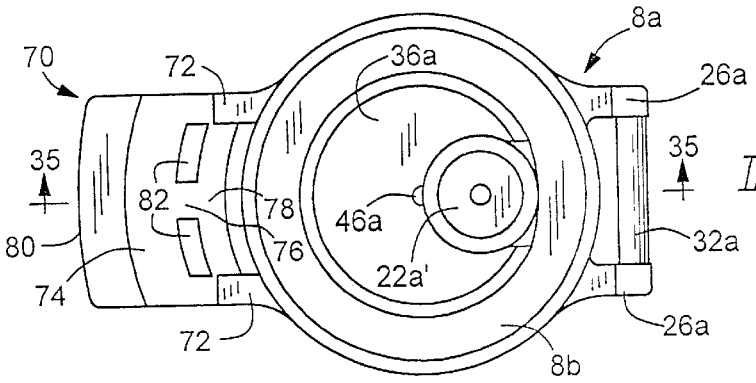
FIG. 32 is a top plan view of a second embodiment of a snap cap for use in the device of the invention for maintaining effervescence of a beverage within a bottle.

Referring to FIGS. 27 to 31, there is illustrated a third embodiment of the lower valve element, designated as valve 20*b*, for use with the valve cap 18 in device 2 of the invention. The upper valve (not shown) for use in device 2 is identical to valve 20*b*, but has a reversed orientation in use in connection with valve cap 18'. Valve 20*b* is intended to improve valve seating. Valve 20*b* is in the form of a plastic disk having a circular periphery 52*b*, a plurality of openings 54*b* and a central portion 56*b*. The central portion 56*b* is interconnected to the periphery 52*b* by three flexure portions 58*b* which allow central portion 56*b* to move relative to periphery 52*b* to close the valve in response to pressure conditions. As seen in FIGS. 30 and 31, the central portion 56*b* has a thickness generally equal to the thickness of periphery 52*b*. The flexure portions 58*b* have a less thickness than central portion 56*b* and periphery 52*b* and are disposed generally at midpoint between opposed faces 20*b*' and 20*b*" of valve 20*b*.

Referring now to FIGS. 32–35 there is illustrated a second embodiment of the snap cap of the invention generally designated by reference numeral 8*a*. The snap cap 8*a* can be used in place of snap cap 8 in device 2 in a similar manner as described previously with reference to FIGS. 1, 2, and 13–18. The snap cap 8*a* functions in a similar manner as snap cap 8, but employs a modified latching means in the form of a modified "V" to provide easy release and locking, even for a child.

The snap cap 8*a* possesses a body 8*b* of a similar external configuration as body 8' of the previous embodiment and connects to downwardly extending spaced rear legs 26*a* interconnected by a horizontal connecting member 32*a*. As with horizontal member 32 of the embodiment of FIGS. 2–8, the horizontal member 32*a* is arranged to be snapped into downwardly facing groove 40 (FIGS. 2–8) formed in the lower portion of a pair of rear projections 42 provided on screw cap 14 in a manner to create the pivot axis of snap cap 8*a* as previously described as seen in FIG. 2. The snap cap 8*a* includes an upper valve and valve cap receiving cavity 22*a*' and a lower valve cap and valve receiving cavity 22*a* as in the previously described snap cap 8. A central passage 46*a* is in fluid communication with chamber 36*a* and valve cavity 22*a*. An atmospheric air passage 49*a* is provided in communication with chamber 22*a*' receiving the upper valve disc and cap of any of the three previously described embodiments.

Figure 35:
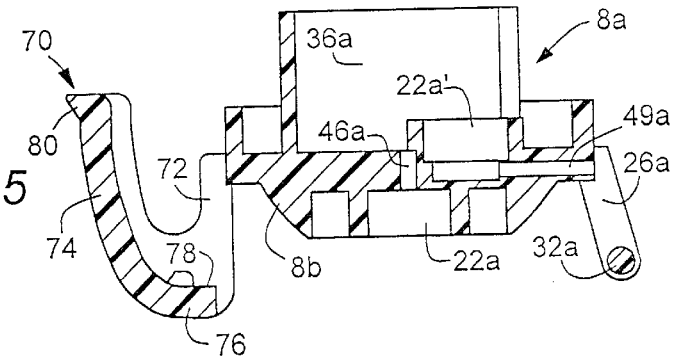
FIG. 35 is a side elevational view, with parts in section, taken along lines 35—35 of FIG. 32.
Figure 33:
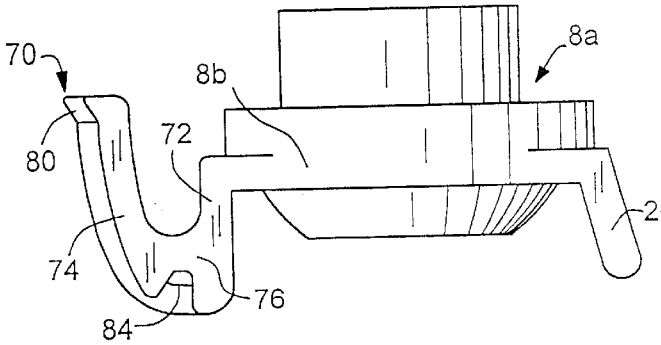
FIG. 33 is a side elevational view of the snap cap of FIG. 33.
Figure 34:
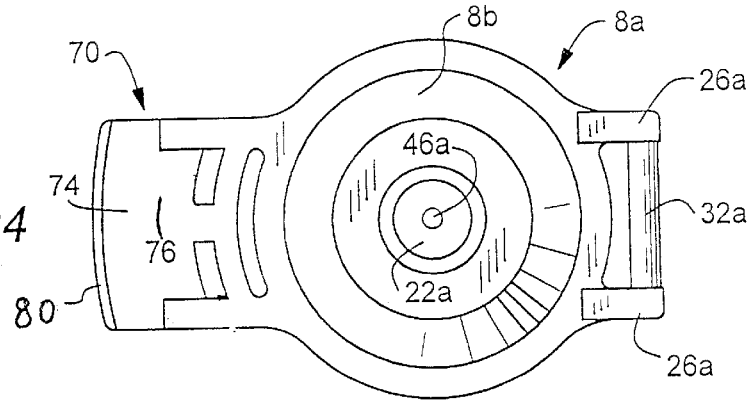
FIG. 34 is a bottom plan view of the snap cap of FIG. 32.

The latch mechanism 70 of snap cap 8*a* is in the form of a modified "V" having a pair of spaced downwardly extending legs 72 integrally formed on body 8*b*. A curved upright wall 74 having a width approximate equal to combined spaced width of spaced legs 72 are integrally attached to legs 72 through interconnecting portion 76. As seen in FIGS. 33 and 35, the legs 72, interconnecting portion 76, and wall 74 form a modified "V" shape from a side perspective. The interconnecting portion 76 extends the width of upright wall 74 and includes an upper surface 78 which snaps into locking relationship with the projections 42 on screw cap in a manner as previously described with reference to FIG. 2 by which the snap cap 8*a* is closed. The upper edge 80 of wall 74 projects outward to allow an individual to easily flex wall 74 and interconnecting portion 76 away from screw cap projections 42 to release the snap cap 8*a*.

A pair of relief openings 82 are provided the interconnecting portion 76 to increase flexibility to reduce the effort required for release. A notch 84 may be formed in the bottom of wall 74 to increase flexibility.

What is claimed is:

1. A device for maintaining effervescence of a liquid comprising body means for attachment adjacent to the opening of a container containing a liquid, said body means having a body air passage in fluid communication with the opening of the container, snap cap means being pivotally mounted on said body means, said snap cap means being pivotally moveable between a locked position on said body means to an unlocked position on said body means, pressurizing means being attached to said snap cap means, said pressurizing means being a deformable hollow body having an internal chamber, said hollow body acting to pressurize the container when manually compressed, said snap cap means having a cap air passage, said cap air passage being in selective fluid communication with said chamber and said body air passage, said snap cap means further having an external air inlet in communication with said cap air passage to introduce external air into said chamber, valve means being operatively connected to said external air inlet and said body air passage, said valve means acting to close said external air inlet and open said body air passage upon said hollow body being manually compressed to displace pressurized air through said cap air passage and said body air passage, said valve means further closes said body air passage and opens said external air inlet upon release of compression of said hollow body, and said valve means having a first valve assembly and a second valve assembly each including a valve cap and a valve element.

2. The device according to claim 1 wherein said valve cap of said first valve assembly and said second valve assembly includes a cavity, said valve element being disposed in said cavity.

3. The device according to claim 2 wherein each of said valve caps includes a passage in fluid communication with said cavity and respectively with said body air passage and said external air passage.

4. The device according to claim 2 wherein valve element of said first valve assembly closes said one passage to block said body air passage and opens the other of said passage to open air body air passage upon said hollow body being compressed.

5. The device according to claim 4 wherein said valve element of said first valve assembly opens said one passage to open said body air passage and closes the other of said passage to close said air body air passage upon manual release of the deformed hollow body.

6. The device according to claim 5 wherein said valve element of said second valve assembly is a flat disk, said disk having a flexure area and a flat surface portion; said flexure area responding to the compression of said hollow body to flex said surface portion from said body air passage and permit pressurized air from sad chamber to be introduced through said body air passage.

7. The device according to claim 5 wherein said valve element of said second valve assembly is a flat disk, said disk having a flexure area response to release of said hollow body to open said air inlet passage.

8. The device according to claim 7 wherein said flexure area of valve element includes a plurality of connecting portions having a thinner thickness than said surface portion.

9. The device according to claim 8 wherein said plurality of connecting portions have a surface coplanar with said surface portion.

10. The device according to claim 8 wherein said connecting portion have a pair of flat surfaces spaced from said surface portion.

11. A device for maintaining effervescence of a liquid comprising body means for attachment adjacent to the opening of a container containing a liquid, said body means having a passage in fluid communication with the opening of the container, snap cap means being pivotally mounted on said body means, said snap cap means being pivotally moveable between a locked position on said body means to an unlocked position on said body means, pressurizing means being attached to said snap cap means and acting to pressurize the container, said snap means having an inlet to introduce external air into said pressurizing means, said snap cap means having projection means, said body means having engagement means for selectively receiving said projection means and locking said snap cap means, said snap cap means further having release means for releasing locking engagement of said projection means and said engagement means, said projection means includes legs and a member connecting said legs, said connecting member having elements to engage said engagement means, and said connecting member includes an upward extending portion, said upward extending portion including flexure means for causing said locking engagement when a force is applied to said upward extending portion.

12. The device according to claim 11 wherein said flexure means is a cutout portion in said upward extending portion.

* * * * *